US007762872B2

(12) United States Patent
Sung

(10) Patent No.: US 7,762,872 B2
(45) Date of Patent: Jul. 27, 2010

(54) SUPERHARD CUTTERS AND ASSOCIATED METHODS

(76) Inventor: Chien-Min Sung, 4, Lane 32, Chung-Cheng Road, Tansui, Taipei County 251 (TW)

( * ) Notice: Subject to any disclaimer, the term of this patent is extended or adjusted under 35 U.S.C. 154(b) by 30 days.

(21) Appl. No.: 11/560,817

(22) Filed: Nov. 16, 2006

(65) Prior Publication Data

US 2007/0155298 A1 Jul. 5, 2007

Related U.S. Application Data

(63) Continuation-in-part of application No. 11/357,713, filed on Feb. 17, 2006, and a continuation-in-part of application No. 11/223,786, filed on Sep. 9, 2005, and a continuation-in-part of application No. 10/925,894, filed on Aug. 24, 2004, now Pat. No. 7,384,436.

(60) Provisional application No. 60/681,798, filed on May 16, 2005.

(51) Int. Cl.
*B24B 7/24* (2006.01)

(52) U.S. Cl. ..... 451/527; 451/548; 51/297

(58) Field of Classification Search ..... 451/527, 451/528, 533, 544, 548; 51/297, 300
See application file for complete search history.

(56) References Cited

U.S. PATENT DOCUMENTS

| | | | | |
|---|---|---|---|---|
| 3,743,489 | A | 7/1973 | Wentorf | |
| 3,767,371 | A | 10/1973 | Wentorf et al. | |
| 3,852,078 | A | 12/1974 | Wakatsuki | |
| 4,481,016 | A | 11/1984 | Campbell et al. | |
| 4,662,896 | A | 5/1987 | Dennis | |
| 4,849,602 | A | 7/1989 | Gardner | |
| 4,923,490 | A * | 5/1990 | Johnson et al. | 51/298 |
| 4,925,457 | A | 5/1990 | deKok et al. | |
| 4,954,139 | A | 9/1990 | Cerutti | |
| 5,049,165 | A | 9/1991 | Tselesin | |
| 5,137,543 | A * | 8/1992 | Heath et al. | 51/298 |
| 5,190,568 | A | 3/1993 | Tselesin | |
| 5,195,403 | A | 3/1993 | Sani et al. | |
| 5,195,404 | A | 3/1993 | Notter et al. | |
| 5,232,320 | A | 8/1993 | Tank et al. | |
| 5,247,765 | A * | 9/1993 | Quintana | 451/548 |
| 5,374,293 | A | 12/1994 | Takashita et al. | |

(Continued)

FOREIGN PATENT DOCUMENTS

| | | |
|---|---|---|
| WO | WO 02/31078 | 4/2002 |

(Continued)

OTHER PUBLICATIONS

Sung, Chien-Min, U.S. Appl. No. 11/724,585, office action issued Jan. 28, 2009.

(Continued)

*Primary Examiner*—Maurina Rachuba
(74) *Attorney, Agent, or Firm*—Thorpe North & Western LLP

(57) ABSTRACT

A cutting device comprises a base having a solidified organic material layer disposed thereon. A plurality of individual polycrystalline cutting elements are secured in the solidified organic material layer. Each of the plurality of individual polycrystalline cutting elements has a substantially matching geometric configuration.

30 Claims, 6 Drawing Sheets

U.S. PATENT DOCUMENTS

| | | | | |
|---|---|---|---|---|
| 5,380,390 | A | 1/1995 | Tselesin | |
| 5,453,106 | A | 9/1995 | Roberts | |
| 5,486,131 | A * | 1/1996 | Cesna et al. | 451/56 |
| 5,505,272 | A * | 4/1996 | Clark | 175/405.1 |
| 5,527,424 | A | 6/1996 | Mullins | |
| 5,536,202 | A | 7/1996 | Appel et al. | |
| 5,547,417 | A | 8/1996 | Breivogel et al. | |
| 5,560,745 | A * | 10/1996 | Roberts | 451/540 |
| 5,560,754 | A | 10/1996 | Johnson et al. | |
| 5,851,138 | A | 12/1998 | Hempel, Jr. | |
| 5,921,856 | A | 7/1999 | Zimmer | |
| 5,924,917 | A * | 7/1999 | Benedict et al. | 451/526 |
| 5,975,988 | A * | 11/1999 | Christianson | 451/28 |
| 6,001,008 | A | 12/1999 | Fujimori et al. | |
| 6,027,659 | A * | 2/2000 | Billett | 216/11 |
| 6,054,183 | A | 4/2000 | Zimmer et al. | |
| 6,093,280 | A | 7/2000 | Kirchner et al. | |
| 6,190,240 | B1 | 2/2001 | Kinoshita et al. | |
| 6,213,856 | B1 | 4/2001 | Cho et al. | |
| 6,217,413 | B1 * | 4/2001 | Christianson | 451/28 |
| 6,224,469 | B1 | 5/2001 | Ohmori et al. | |
| 6,281,129 | B1 | 8/2001 | Easter et al. | |
| 6,293,854 | B1 * | 9/2001 | Kimura et al. | 451/56 |
| 6,299,508 | B1 | 10/2001 | Gagliardi et al. | |
| 6,319,108 | B1 | 11/2001 | Adefris et al. | |
| 6,346,202 | B1 | 2/2002 | Molnar | |
| 6,354,918 | B1 | 3/2002 | Togawa et al. | |
| 6,368,198 | B1 | 4/2002 | Sung et al. | |
| 6,371,838 | B1 | 4/2002 | Holzapfel | |
| 6,371,842 | B1 * | 4/2002 | Romero | 451/540 |
| 6,439,986 | B1 * | 8/2002 | Myoung et al. | 451/443 |
| 6,446,740 | B2 * | 9/2002 | Eyre | 175/426 |
| 6,478,831 | B2 | 11/2002 | Tselesin | |
| 6,626,167 | B2 | 9/2003 | Kim et al. | |
| 6,672,943 | B2 | 1/2004 | Vogtmann et al. | |
| 6,694,847 | B2 | 2/2004 | Hiroyasu et al. | |
| 6,755,720 | B1 | 6/2004 | Ishizaki et al. | |
| 6,818,029 | B2 | 11/2004 | Myoung et al. | |
| 6,824,455 | B2 | 11/2004 | Osterheld et al. | |
| 6,884,155 | B2 | 4/2005 | Sung | |
| 6,945,857 | B1 | 9/2005 | Doan et al. | |
| 7,021,995 | B2 | 4/2006 | Toge et al. | |
| 7,033,408 | B2 | 4/2006 | Fries et al. | |
| 7,044,990 | B2 | 5/2006 | Ishizaki et al. | |
| 7,066,795 | B2 * | 6/2006 | Balagani et al. | 451/285 |
| 7,201,645 | B2 | 4/2007 | Sung | |
| 7,258,708 | B2 | 8/2007 | Sung | |
| 7,261,621 | B2 | 8/2007 | Moon et al. | |
| 7,465,217 | B2 | 12/2008 | Kinoshita et al. | |
| 2001/0009844 | A1 | 7/2001 | Cho et al. | |
| 2002/0042200 | A1 | 4/2002 | Fawcett | |
| 2002/0127962 | A1 | 9/2002 | Cho et al. | |
| 2002/0173234 | A1 | 11/2002 | Sung et al. | |
| 2003/0084894 | A1 | 5/2003 | Sung | |
| 2003/0114094 | A1 | 6/2003 | Myoung et al. | |
| 2003/0207659 | A1 | 11/2003 | Annen et al. | |
| 2005/0060941 | A1 | 3/2005 | Provow | |
| 2005/0118939 | A1 | 6/2005 | Duescher | |
| 2005/0260939 | A1 | 11/2005 | Andrews et al. | |
| 2006/0079160 | A1 | 4/2006 | Balagani et al. | |
| 2006/0143991 | A1 | 7/2006 | Sung | |
| 2006/0254154 | A1 | 11/2006 | Huang et al. | |
| 2007/0051355 | A1 | 3/2007 | Sung | |
| 2007/0066194 | A1 | 3/2007 | Wielonski et al. | |
| 2007/0264918 | A1 | 11/2007 | Sung | |

FOREIGN PATENT DOCUMENTS

| | | |
|---|---|---|
| WO | WO2004/094106 | 11/2004 |

OTHER PUBLICATIONS

Sung, Chien-Min, U.S. Appl. No. 11/357,713, office action issued Jan. 30, 2009.
Sung, Chien-Min, U.S. Appl. No. 11/786,426, office action issued Dec. 3, 2008.
Sung, U.S. Appl. No. 11/223,786, filed Sep. 9, 2005, office action issued Jun. 9, 2008.
Sung, U.S. Appl. No. 11/804,221, filed May 16, 2007.
Sung, U.S. Appl. No. 11/724,585, filed Mar. 14, 2007, office action issued Aug. 14, 2008.
U.S. Appl. No. 11/786,426, filed Apr. 10, 2007, Chien-Min Sung. Final office action issued Mar. 13, 2009.
U.S. Appl. No. 11/804,221, Chien-Min Sung. Office action issued Jan. 16, 2009.
U.S. Appl. No. 11/223,786, filed Sep. 9, 2005, Chien-Min Sung. Office action issued Jun. 17, 2009.
U.S. Appl. No. 11/891,304, filed Aug. 8, 2007, Chien-Min Sung. Office action issued Jul. 23, 2009.
U.S. Appl. No. 11/724,585, filed Mar. 14, 2007, Chien-Min Sung. Office action issued Jul. 27, 2009.
U.S. Appl. No. 11/357,713, filed Feb. 17, 2006, Chien-Min Sung. Office action issued Aug. 3, 2009.
Sung, U.S. Appl. No. 11/357,713, filed Feb. 17, 2006, final office action issued Sep. 2, 2008.
Sung, U.S. Appl. No. 11/786,426, filed Apr. 10, 2007, office action issued Jun. 3, 2008.
U.S. Appl. No. 11/223,786 filed Sep. 9, 2005, Chien-Min Sung. Office action issued Jan. 1, 2010.
U.S. Appl. No. 11/357,713 filed Feb. 17, 2006, Chien-Min Sung. Office action issued Jan. 14, 2010.

* cited by examiner

SUPERHARD CUTTERS AND ASSOCIATED METHODS

PRIORITY DATA

This application is a continuation-in-part of copending U.S. patent application Ser. No. 11/357,713, filed Feb. 17, 2006, which claims priority to U.S. Provisional Patent Application Ser. No. 60/681,798, filed May 16, 2005; and is a continuation-in-part of copending U.S. patent application Ser. No. 11,223,786, filed Sep. 9, 2005; and is a continuation-in-part of U.S. patent application Ser. No. 10/925,894, filed Aug. 24, 2004, now U.S. Pat. No. 7,384,436, all of which are hereby incorporated herein by reference in their entirety to the extent they are consistent with the disclosure herein.

FIELD OF THE INVENTION

The present invention relates generally to cutting devices used to remove material from (e.g., plane, smooth, polish, dress, etc.) workpieces formed of various materials. Accordingly, the present invention involves the fields of chemistry, physics, and materials science.

BACKGROUND OF THE INVENTION

It is estimated that the semiconductor industry currently spends more than one billion U.S. Dollars each year manufacturing silicon wafers that exhibit very flat and smooth surfaces. Typically, chemical mechanical polishing ("CMP") is used in the manufacturing process of semiconductor devices to obtain smooth and even-surfaced wafers. In a conventional process, a wafer to be polished is generally held by a carrier positioned on a polishing pad attached above a rotating platen. As slurry is applied to the pad and pressure is applied to the carrier, the wafer is polished by relative movement of the platen and the carrier.

While this well-known process has been used successfully for many years, it suffers from a number of problems. For example, this conventional process is relatively expensive and is not always effective, as the silicon wafers may not be uniform in thickness, nor may they be sufficiently smooth, after completion of the process. In addition to becoming overly "wavy" when etched by a solvent, the surface of the silicon wafers may become chipped by individual abrasive grits used in the process. Moreover, if the removal rate is to be accelerated to achieve a higher productivity, the grit size used on the polishing pad must be increased, resulting in a corresponding increase in the risk of scratching or gouging expensive wafers. Furthermore, because surface chipping can be discontinuous, the process throughput can be very low. Consequently, the wafer surface preparation of current state-of-the-art processes is generally expensive and slow.

In addition to these considerations, the line width (e.g., nodes) of the circuitry on semiconductors is now approaching the virus domain (e.g., 10-100 nm). In addition, more layers of circuitry are now being laid down to meet the increasing demands of advanced logic designs. In order to deposit layers for making nanometer sized features, each layer must be extremely flat and smooth during the semiconductor fabrication. While diamond grid pad conditioners have been effectively used in dressing CMP pads for polishing previous designs of integrated circuitry, they have not been found suitable for making cutting-edge devices with nodes smaller than 65 nm. This is because, with the decreasing size of the copper wires, non-uniform thickness due to rough- or over-polishing will change the electrical conductivity dramatically. Moreover, due to the use of coral-like dielectric layers, the fragile structure must be polished very gently to avoid disintegration. Hence, the pressure used in CMP processes must be reduced significantly.

In response, new CMP processes, such as those utilizing electrolysis (e.g. Applied Materials ECMP) of copper or those utilizing air film cushion support of wafer (e.g. Tokyo Semitsu), are being pursued to reduce the polishing pressure on the contact points between wafer and pad. However, as a consequence of gentler polishing action, the polishing rate of the wafer will decrease. To compensate for the loss of productivity, polishing must occur simultaneously over the entire surface of the wafer. In order to do so, the contact points between the wafer and the pad must be smaller in area, but more numerous in frequency. This is in contrast to current CMP practice in which the contacted areas are relatively large but relatively few in number.

Thus, in order to polish fragile wafers more and more gently, the CMP pad asperities must be reduced. However, to prevent the polishing rate from declining, more contact points must be created. Consequently, the pad asperities need to be finer in size but more in number. However, the more delicate the polishing process becomes, the higher the risk of scratching the surface of the wafer becomes. In order to avoid this risk, the highest tips of all asperities must be fully leveled. Otherwise, the protrusion of a few "killer asperities" can ruin the polished wafer.

SUMMARY OF THE INVENTION

The present invention provides a cutting device, including a base having a solidified organic material layer disposed thereon, and a plurality of individual polycrystalline cutting elements secured in the solidified organic material layer. Each of the plurality of individual polycrystalline cutting elements can have a matching geometric configuration.

In accordance with another aspect of the invention, a cutting device is provided, including a base having a solidified organic material layer attached thereto, and a plurality of individual polycrystalline cutting elements secured in the solidified organic material layer. Each of the plurality of individual polycrystalline cutting elements can include at least one cutting tip. The cutting tips of the cutting elements can be aligned in a common plane.

In accordance with another aspect of the invention, a method of forming a cutting device is provided, including: obtaining a substrate; arranging on the substrate a plurality of individual polycrystalline cutting elements, each of the plurality of individual polycrystalline cutting elements can have a matching geometric configuration; and securing each of the plurality of individual polycrystalline cutting elements to the substrate with a solidified organic material layer.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying exemplary claims, or may be learned by the practice of the invention.

Figures 1A, 1B:
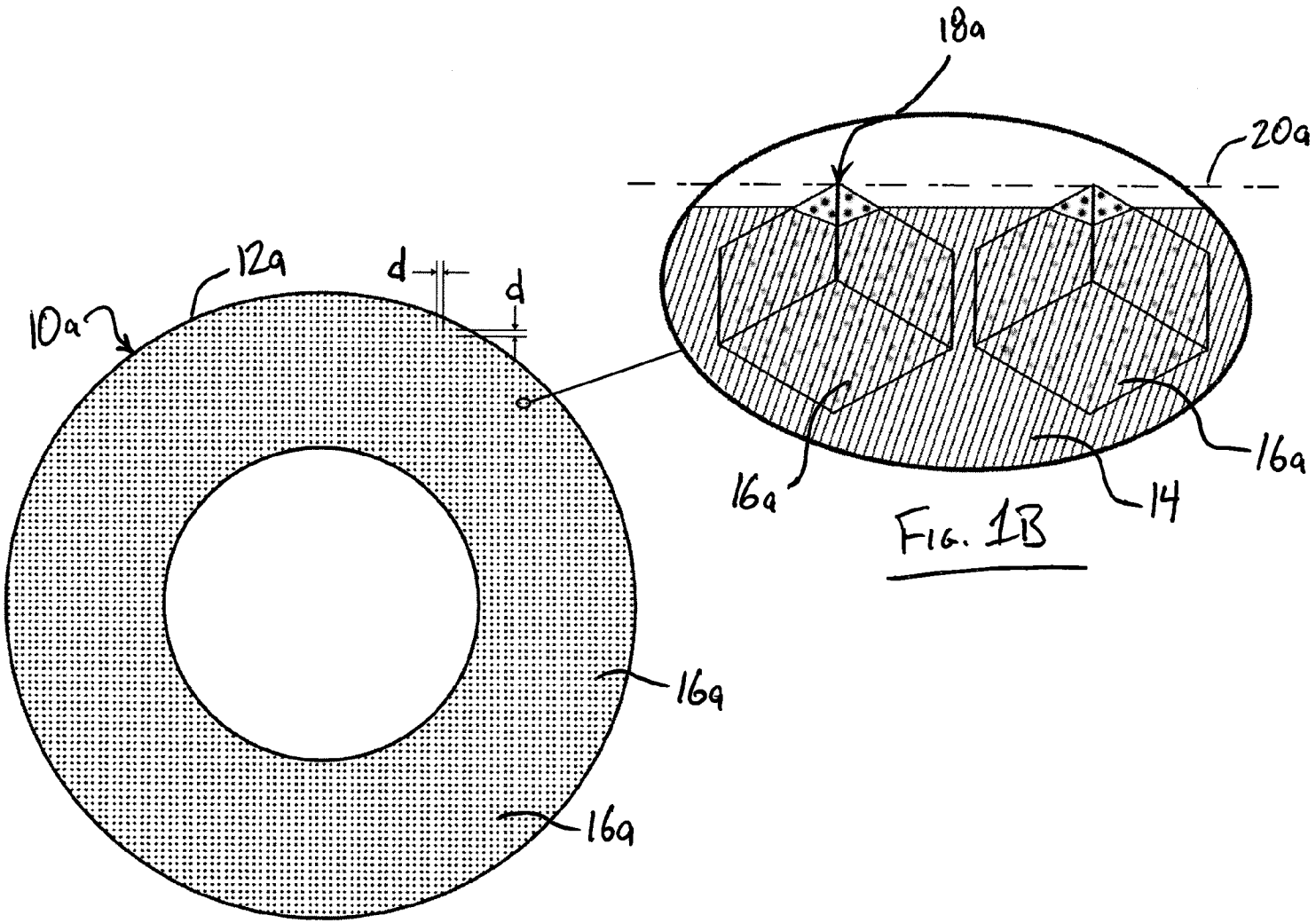
FIG. 1A is a schematic, top plan view of a cutting device in accordance with an embodiment of the invention.
FIG. 1B is an enlarged view of a portion of the cutting device of FIG. 1A.

It will be understood that the above figures are merely for illustrative purposes in furthering an understanding of the invention. Further, the figures may not be drawn to scale, thus dimensions, particle sizes, and other aspects may, and generally are, exaggerated to make illustrations thereof clearer. Therefore, departure can be made from the specific dimensions and aspects shown in the figures in order to produce the cutting devices of the present invention.

DETAILED DESCRIPTION

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an" and "the" include plural referents unless the context clearly dictates otherwise. Thus, for example, reference to "a cutting element" includes one or more of such elements.

Definitions

In describing and claiming the present invention, the following terminology will be used in accordance with the definitions set forth below.

All mesh sizes referred to herein are U.S. mesh unless otherwise indicated. Further, mesh sizes are generally understood to indicate an average mesh size of a given collection of particles since each particle within a particular "mesh size" may actually vary over a small distribution of sizes.

As used herein, "substantial," or "substantially," refers to the functional achievement of a desired purpose, operation, or configuration, as though such purpose or configuration had actually been attained. Therefore, cutting edges or tips that are substantially aligned in a common plane function as though, or nearly as though, they were precisely aligned in such a plane.

Furthermore, when used in an exclusionary context, such as a material "substantially lacking" or being "substantially devoid of," or "substantially free of" an element, the terms "substantial" and "substantially" refer to a functional deficiency of the element to which reference is being made. Therefore, it may be possible that reference is made to a material in which an element is "substantially lacking," when in fact the element may be present in the material, but only in an amount that is insufficient to significantly affect the material, or the purpose served by the material in the invention.

As used herein, a "common plane" refers to a profile, including planar or contoured profiles, above a base surface with which the peaks or tips of cutting elements are to be aligned. Examples of such profiles may include, without limitation, flat profiles, wavy profiles, convex profiles, concave profiles, multi-tiered profiles, and the like.

As used herein, cutting "edge" refers to a portion of a cutting element that includes some measurable width across a portion that contacts and removes material from a workpiece. As an exemplary illustration, a typical knife blade has a cutting edge that extends longitudinally along the knife blade, and the knife blade would have to be oriented transversely to a workpiece to scrape or plane material from the workpiece in order for the cutting "edge" of the knife blade to remove material from the workpiece.

As used herein, cutting "tip" refers to a portion of a cutting element that protrudes the greatest distance from a bonding material, e.g., that is the first portion of the cutting element that contacts a workpiece when the article of the present invention is in use. It is to be understood that a cutting "tip" can include a planar surface, a pointed surface, or an edge; so long as the planar surface, pointed surface or edge of the cutting element is the first portion of the cutting element that contacts a workpiece from which material is to be removed with a cutting device to which the cutting element is attached.

As used herein, "sintering" refers to the joining of two or more individual particles to form a continuous solid mass. The process of sintering involves the consolidation of particles to at least partially eliminate voids between particles. Sintering may occur in either metal or carbonaceous particles, such as diamond. Sintering of metal particles occurs at various temperatures depending on the composition of the material. Sintering of diamond particles generally requires ultra-high pressures and the presence of a carbon solvent as a diamond sintering aid, and is discussed in more detail below. Sintering aids are often present to aid in the sintering process and a portion of such may remain in the final product.

As used herein, "superhard" may be used to refer to any crystalline, or polycrystalline material, or mixture of such materials which has a Mohr's hardness of about 8 or greater. In some aspects, the Mohr's hardness may be about 9.5 or greater. Such materials include but are not limited to diamond, polycrystalline diamond (PCD), cubic boron nitride (cBN), polycrystalline cubic boron nitride (PcBN) as well as other superhard materials known to those skilled in the art. Superhard materials may be incorporated into the present invention in a variety of forms including particles, grits, films, layers, etc. However, in most cases, the superhard materials of the present invention are in the form of polycrystalline superhard materials, such as PCD and PcBN materials. It is important to note that distinctions are made in the present disclosure between conventional superhard grits and polycrystalline superhard materials.

As used herein, "geometric configuration" refers to a shape that is capable of being described in readily understood and recognized mathematical terms. Examples of shapes qualifying as "geometric configurations" include, without limitation, cubic shapes, polyhedral (including regular polyhedral) shapes, triangular shapes (including equilateral triangles, isosceles triangles and three-dimensional triangular shapes), pyramidal shapes, spheres, rectangles, "pie" shapes, wedge shapes, octagonal shapes, circles, etc.

As used herein, "organic material" refers to a semisolid or solid complex amorphous mix of organic compounds. As such, "organic material layer" and "organic material matrix" may be used interchangeably, refer to a layer or mass of a semisolid or solid complex amorphous mix of organic compounds. Preferably the organic material will be a polymer or copolymer formed from the polymerization of one or more monomers.

As used herein, "particle" and "grit" may be used interchangeably.

As used herein, "cutting element" describes a variety of structures capable of removing (e.g., cutting) material from a workpiece. A cutting element can be a mass having several cutting points, ridges or mesas formed thereon or therein. It is notable that such cutting points, ridges or mesas may be from a multiplicity of protrusions or asperities included in the mass. Furthermore, a cutting element can also include an individual particle that may have only one cutting point, ridge or mesa formed thereon or therein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, particle sizes, volumes, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 micrometer to about 5 micrometers" should be interpreted to include not only the explicitly recited values of about 1 micrometer to about 5 micrometers, but also include individual values and sub-ranges within the indicated range. Thus, included in this numerical range are individual values such as 2, 3, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

The Invention

The present invention provides a cutting device and associated methods that can be utilized in cutting or otherwise affecting a workpiece to remove material from the workpiece and provide a finished, smooth and/or flat surface to the workpiece. Cutting devices of the present invention can be advantageously utilized, for example, as planing devices that plane material from a workpiece, as dressing devices that dress various workpieces, and as polishing devices that polish various workpieces.

In the embodiment of the invention illustrated in FIGS. 1A and 1B, a cutting device (e.g., disk) 10*a* is provided that includes a base 12*a* that can have a solidified organic material layer (14 in FIGS. 1B and 2B) disposed thereon, attached thereto, or otherwise associated therewith. A plurality of individual polycrystalline cutting elements 16*a* can be secured in the solidified organic material layer. Each of the plurality of individual polycrystalline cutting elements can have or exhibit a substantially matching geometric configuration, e.g., the geometric configuration of the cutting elements can substantially match that of other of the cutting elements. In the example illustrated in FIG. 1B, each of the plurality of individual polycrystalline cutting elements 16*a* has geometric configuration that is substantially cubic in nature. In the embodiment illustrated in FIG. 2B, the individual polycrystalline cutting elements 16*b* have a geometric configuration that can be characterized as a three-dimensional triangular configuration.

Figure 2B:
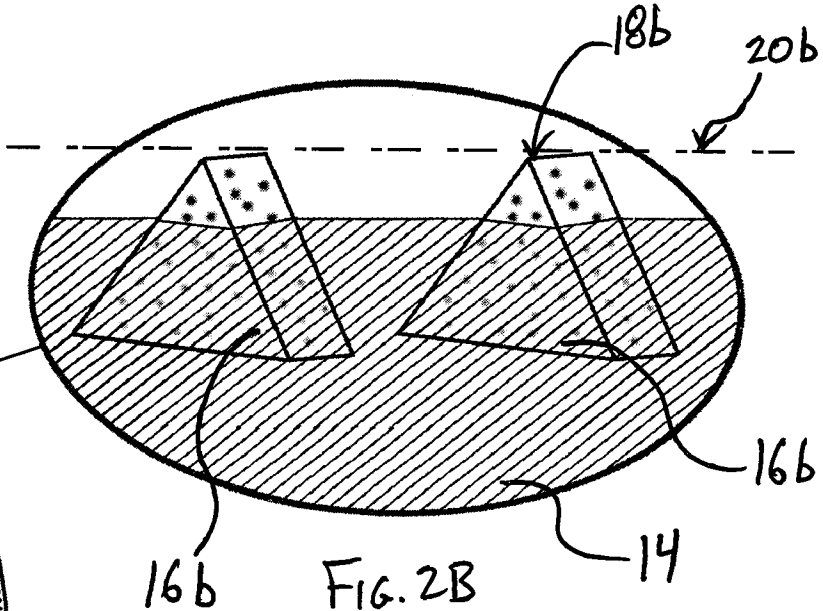
FIG. 2B is an enlarged view of a portion of the cutting device of FIG. 2A.

As illustrated in both FIGS. 1B and 2B, in one aspect of the invention, the plurality of individual polycrystalline cutting elements 16*a*, 16*b* can include at least one cutting tip (18*a* and 18*b*, respectively), with the cutting tips of the cutting elements being aligned in a common plane (20*a*, 20*b*, respectively). In this example, the common plane is a flat plane of predetermined height above the solidified organic matrix. Thus, the plurality of individual polycrystalline cutting elements can be held within the solidified organic material layer in a very precise manner such that each of the cutting elements contacts a workpiece (not shown) from which material is to be removed at substantially the same depth. In this way, each of the individual polycrystalline cutting elements can be subject to substantially the same level of drag force as the cutting device is moved relative to a workpiece. This feature of the invention can advantageously limit the premature removal of individual cutting elements that might otherwise shorten the life of the tool, and/or damage the workpiece being treated.

The individual cutting elements 16*a*, 16*b* can be formed from a variety of materials including, in one embodiment, a polycrystalline material or a superhard polycrystalline material. While not so limited, the superhard polycrystalline material can be a polycrystalline diamond compact ("PCD") or a polycrystalline cubic boron nitride compact ("PcBN"). The PCD or PcBN compact can be formed in a variety of manners, as discussed in more detail below. By forming the individual cutting elements from a polycrystalline material, and attaching the cutting elements individually to the cutting device, the beneficial properties of polycrystalline cutting elements can be achieved without requiring that portions of the cutting device not used for cutting also be formed from the polycrystalline material. Thus, considerable cost savings can be achieved.

The cutting devices of the present invention can be utilized in a number of applications, and in one embodiment are particularly well adapted for use in planing substantially brittle materials, such as silicon wafers, glass sheets, metals, used silicon wafers to be reclaimed by planarization, LCD glass, LED substrates, SiC wafers, quartz wafers, silicon nitride, zirconia, etc. In conventional silicon wafer processing techniques, a wafer to be polished is generally held by a carrier positioned on a polishing pad attached above a rotating platen. As slurry is applied to the pad and pressure is applied to the carrier, the wafer is polished by relative movements of the platen and the carrier. Thus, the silicon wafer is essentially ground or polished, by very fine abrasives, to a relatively smooth surface.

While grinding of silicon wafers has been used with some success, the process of grinding materials such as silicon wafers often results in pieces of the material being torn or gouged from the body of the material, resulting in a less than desirable finish. This is due, at least in part, to the fact that grinding or abrasive processes utilize very sharp points of abrasive materials (which are often not level relative to one another) to localize pressure to allow the abrasives to remove material from a workpiece.

The PCD or PcBN cutting elements of the present invention are generally superhard, resulting in little yielding by the cutting elements when pressed against a wafer. As hardness is generally a measure of energy concentration, e.g., energy per unit volume, the PCD or PcBN compacts of the present invention are capable of concentrating energy to a very small volume without breaking. These materials can also be maintained with a very sharp cutting edge due to their ability to maintain an edge within a few atoms.

While not so required, in one embodiment of the invention shown in FIG. 1A, the individual polycrystalline cutting elements 16*a* can be arranged across the base in a grid pattern, e.g., in a pattern of squares. The cutting elements can be evenly spaced from one another at a distance "d" of from about 100 microns to about 800 microns. In one aspect of the invention, the individual polycrystalline cutting elements can be evenly spaced from one another at a distance "d" of about 500 microns.

Figure 2A:
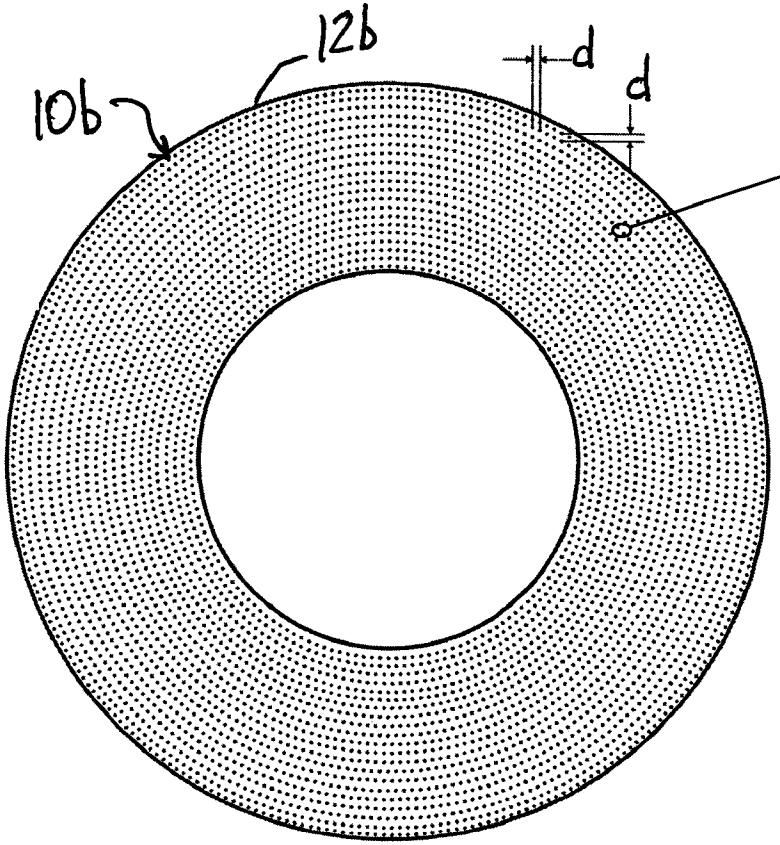
FIG. 2A is a schematic, top plan view of a cutting device in accordance with another embodiment of the invention.

In the embodiment of the invention illustrated in FIG. 2A, the individual polycrystalline cutting elements 16*b* can be arranged across the base as a series of concentric circles. As in the embodiment discussed above, the individual cutting elements can be evenly spaced from one another at a distance "d" of from about 100 microns to about 800 microns. In one aspect, the individual polycrystalline cutting elements can be evenly spaced from one another at a distance "d" of about 500 microns. By evenly spacing the individual cutting elements one from another, the drag force applied to the cutting elements during the cutting process can be evenly distributed among each of the cutting elements, eliminating or reducing the risk of premature pullout of one or more individual cutting elements. Premature pullout of one or more individual cutting elements can result in serious damage being done the workpiece being worked upon.

The retention of an individual polycrystalline cutting element in an organic material layer can be greatly improved by arranging the cutting elements the organic material layer such that mechanical stress impinging on any individual cutting element is minimized. By reducing the stress impinging on each individual cutting element they can be more readily retained in a solidified organic material layer, particularly for delicate tasks.

Various configurations or arrangements are contemplated for minimizing the mechanical stress impinging on the cutting elements held in the abrading tool. In addition to the spacing considerations discussed above, one potentially useful parameter may include the height that the elements protrude above the organic material layer. A cutting element that protrudes to a significantly greater height than other cutting elements will experience a greater proportion of the impinging mechanical forces and thus is more prone to pull out of the solidified organic material layer. Thus, an even height distribution of the cutting elements may function to more effectively preserve the integrity of the abrading tool as compared to abrading tools lacking such an even height distribution.

As such, in one aspect, a majority of the plurality of individual cutting elements may protrude to a predetermined height above the solidified organic material layer. Though any predetermined height that would be useful in an abrading or cutting tool would be considered to be within the presently claimed scope, in one specific aspect the predetermined height may produce a cutting depth of less than about 20 microns when used to abrade a workpiece. In another specific aspect, the predetermined height may produce a cutting depth of from about 1 micron to about 20 microns when used to abrade a workpiece. In yet another specific aspect, the predetermined height may produce a cutting depth of from about 10 micron to about 20 microns when used to abrade a workpiece. In yet another aspect, the predetermined height may produce a depth of up to or more than 50 or 100 microns.

It should also be noted that the leveling of the individual cutting elements to a predetermined height may be dependent on cutting element spacing. In other words, the farther the cutting elements are separated, the more the impinging forces will affect each cutting element. As such, patterns with increased spacing between the cutting elements may benefit from a smaller variation from predetermined height.

It may also be beneficial for the cutting elements to protrude from the solidified organic material layer to a predetermined height or series of heights that is/are along a designated profile. Numerous configurations for designated profiles are possible, depending on the particular use of the abrading tool. In one aspect, the designated profile may be a plane. In planar profiles, the highest protruding points of the cutting elements are intended to be substantially level. It is important to point out that, though it is preferred that these points align with the designated profile, there may be some height deviation between cutting elements that occur due to limitations inherent in the manufacturing process.

In addition to planar profiles, in another aspect of the present invention the designated profile has a slope. Tools having sloping surfaces may function to more evenly spread the frictional forces impinging thereon across the cutting elements, particularly for rotating tools such as disk sanders and CMP pad dressers. The greater downward force applied by higher central portions of the tool may offset the higher rotational velocity at the periphery, thus reducing the mechanical stress experienced by cutting elements in that location. As such, the slope may be continuous from a central point of the tool to a peripheral point, or the slope may be discontinuous, and thus be present on only a portion of the tool. Similarly, a given tool may have a single slope or multiple slopes. In certain aspects, the tool may slope in a direction from a central point to a peripheral point, or it may slope from a peripheral point to a central point.

Various slopes are contemplated that may provide a benefit to solidified organic material layer tools. It is not intended that the claims of the present invention be limited as to specific slopes, as a variety of slopes in numerous different tools are possible. In one aspect, however, a CMP pad dresser may benefit from an average slope of 1/1000 from the center to the periphery.

As a variation on tools having a slope, in certain aspects the designated profile may have a curved shape. One specific example of a curved shape is a dome shape tool. Such curved profiles function in a similar manner to the sloped surfaces. Tools may include such curved profiles in order to more effectively distribute the frictional forces between all of the cutting elements, thus reducing failures of individual particles and prolonging the life of the tool.

As has been mentioned herein, while it is intended that the tips of the cutting elements align along the designated profile, some level of deviation may occur. These deviations may be a result of the design or manufacturing process of the tool. Given the wide variety of sizes and shapes of cutting elements that may potentially be utilized in a given tool, such deviations may be highly dependent on a particular application. Also, when referring to the designated profile, it should be noted that the term "tip" is intended to include the highest protruding point of a cutting element, whether that point be an apex, an edge, or a face.

As such, in one aspect a majority of the plurality of cutting elements is arranged such that the tips vary from the designated profile by from about 1 micron to about 150 microns. In another aspect, the plurality of cutting elements are arranged such that their tips vary from the designated profile by from about 5 microns to about 100 microns. In yet another aspect, the plurality of cutting elements are arranged such that their tips vary from the designated profile by from about 10 microns to about 75 microns. In a further aspect, the plurality of cutting elements are arranged such that their tips vary from the designated profile by from about 10 microns to about 50 microns. In another aspect, they are arranged such that their tips vary from the designated profile by from about 50 microns to about 150 microns. In yet another aspect, they are arranged such that their tips vary from the designated profile by from about 20 microns to about 100 microns. In a further aspect, they are arranged such that their tips vary from the designated profile by from about 20 microns to about 50 microns.

In another aspect, the plurality of cutting elements are arranged such that their tips vary from the designated profile by from about 20 microns to about 40 microns. Additionally, in one aspect, they are arranged such that their tips vary from the designated profile by less than about 20 microns. In another aspect, they are arranged such that their tips vary from the designated profile by less than about 10 microns. In yet another aspect, they are arranged such that their tips vary from the designated profile by less than about 5 microns. In yet another aspect, they are arranged such that their tips vary from the designated profile by less than about 1 micron. In a further aspect, a majority of the plurality of the cutting elements are arranged such that their tips vary from the designated profile to less than about 10% of the average size of the cutting elements.

The determination of the distance that the tips of the cutting elements extend from the organic binder can also be affected by considering how much of the cutting elements extend above the binder compared to how much of the cutting elements remain submerged beneath the binder surface. In the embodiment illustrated in FIGS. 1A and 1B, a ratio of an amount the cutting elements 16*a* protrude above the binder to an amount submerged beneath the binder is about 4 to 1. In the embodiment illustrated in FIGS. 2A and 2B, about ⅔ of the cutting elements 16*b* are submerged, with about ⅓ being exposed above the binder. Other ratios are also possible, from a 20 to 1 ratio to about 0.2 to 1, inclusive of ranges therebetween.

By forming the individual cutting elements in the shapes described herein, a relatively large portion of the cutting elements 16*a*, 16*b* can be submerged beneath the organic binder. In this manner, the area that affords the greatest cross section for engagement with the binder material is "buried" beneath the greatest amount of binder. This feature of the invention, namely that the widest (i.e. largest cross section of the cutting element) is closer to one end of the particle than the other, and thus the wider end can be placed below the surface of the organic matrix, provides great retention advantages over conventional diamond, or synthetic diamond, grits wherein a largest cross section of the grit is concentrated near a midpoint of the grit, and thus is placed at or near the surface of a matrix in which the grit is held. The widest portion may be at or near the end that is most distal from the working (e.g., cutting) end of the cutting element.

In addition to the shapes of cutting elements illustrated in the figures, in one embodiment of the invention, the cutting elements are formed in pyramidal shapes. The present inventor has found that such a configuration provides a number of advantages. For example, pyramidal-shaped cutting elements concentrate most of the volume/mass of the cutting element toward a lowermost portion of the cutting element, ensuring that the cutting element is more securely held to whichever type of base (e.g., cutting tool) the elements are bonded to, integrated with, or other associated with. In addition, by forming pyramids with a triangular base, the support base of the pyramids is even more massive relative to the tip, and the tip can be made sharper (e.g., 60 degrees) without breaking or fracturing during the dressing of CMP pads.

In general, sharper tips will cut pads faster, leading to a corresponding reduction in total dressing time. Moreover, the asperities formed on the pad are also sharper and more dense. Such asperities can polish wafers, and/or dress CMP pads faster without causing undesirable non-uniformity on the wafer. Alternatively, square pyramids can be used when a lower cut rate is desired, as the tip angle likely has a larger magnitude (e.g. 90 degrees). Thus creating a wider cut path with greater drag and resulting in a lower cut rate. However, the square PCD cutter can be formed more sharply than conventional, single crystal diamond grits that have variable tip angles ranging from 90 degrees to over 125 degrees. Thus, pyramids formed of polycrystalline materials are generally much more effective cutters, with triangular pyramids (i.e. 3 sided) being particularly effective.

In addition, as the cutting elements of the present invention can be made with very closely controlled geometry, the present polycrystalline cutting elements can cut pads with less tearing. Also, with the addition of the secondary cutting elements formed on the major cutting elements, the present cutting elements can perform even better. In contrast, single crystal grits are generally very smooth, so they can cause a lot of plastic deformation on the pad and tearing of cut "shreads."

In addition, oftentimes pad conditioners dress pads under conditions in which work load is unevenly distributed across the cutting elements. Specifically, the outer rim of cutting elements often must do the most cutting work, with the interior elements not being subject to a as high a degree of stress. One manner in which the present invention addresses this problem is by configuring the "outer" cutting elements, some times as PCD grits, (e.g., those located closer to the outer perimeter of the cutting or dressing tool) more robust, and/or the inner elements slightly higher (e.g. about 10 microns higher) than the outer elements. The outer cutting elements can also be disposed on the cutting tool at a greater density, e.g., they can be spaced closer together, and/or be positioned at a slightly lower elevation. In this design, the distribution of cutting elements may not be in grid form, but can include a series of concentric rings that can be radially symmetric.

In one embodiment of the invention, the outer elements can be formed with larger support bases relative to the cutting tips (in one aspect they can have triangular bases), and they may also have an edge formed on the cutting tip rather than just a point. Also, the outermost cutting elements may have a small (e.g. 50 microns) mesa formed at their cutting tips that can cut the pad with edge of the mesa rather than with a straight edge or a point.

In one embodiment of the invention, the cutting elements can be pyramids that are asymmetrical in shape. For example, since the cutting force is generally applied from "outside to inside," the pyramid design may have a relatively steeply sloped wall facing the outer perimeter of the cutting device, but with a relatively gentler slope (e.g. 10 degrees from the horizontal plane) in the trailing side. That is, the table portion on the tip of the pyramid may not be horizontal, but may exhibit a slight "tilt" toward inward to allow debris to escape more easily. This aspect of the invention differs from diamond grit cutting pads, as such conventional cutting pads include a negative angle such that the tearing or cutting force is superimposed with a compressive force. This embodiment of the invention can allow cutting without a great deal of compression so the removal of pad "shread" is much easier.

In other words, the present invention allows a majority of the energy consumed to be used in cutting, rather than plastic deformation. This advantage can be further improved upon by forming the vertical wall of the pyramids such that they slope slightly less than 90 degrees (e.g., about 80 degrees). In this case the table of the pyramids can be sharper on the top of the mesa, similar to an inverted pyramid. This can improve the efficiency of pad cutting because the cutting is performed with a positive angle, similar to a razor blade used in shaving. Such a design has not been possible with single crystal diamond designs, as the cutting edge contact with such designs is always negative in angle. The present pyramidal cutting elements can provide positive cutting edges that are not subject to premature failure due, at least in part, to its ability to support such a cutting edge with a more gently sloping wall on the trailing side of the cutting interface (e.g., with the asymmetrical shape of the pyramids). In one aspect, such an asymmetry can be formed by wire-EDM cutting, and it can be formed with pyramids with tips of point, edge, and mesa tops. Also, when the cutting elements are individual particles or grits, such particle or grit can receive the intended configuration, including an assymetrical configuration as described above by using a mold with a proper shape for processing of the PCT particle.

In one embodiment of the invention, the spacing of the pyramids can be adjusted to adjust the contact pressure of each cutting point, edge or mesa. In general, the farther the pyramids are spaced from one another, the higher the contact pressure between the pyramid and the pad. Thus, the fewer tips present to support the applied force, the deeper the penetration of each of the tips and the larger the formed asperities. Generally, the polishing rate of the wafer is dependent on the number and size of the asperities. Denser, smaller asperities can polish as fast as fewer, larger asperites. But the former is more uniform with no excessive force that may cause non-uniformity, scratching, erosion or dishing of the delicate wafer, etc. This can be particularly true with copper smaller than 90 nm and with low-k dielectric having greater than 20% pores.

The individual polycrystalline cutting elements can be formed in a variety of manners and from a variety of materials, as would occur to one having ordinary skill in the relevant art. In one aspect of the invention, the cutting elements are sintered polycrystalline diamond cubes with silicon/SiC as the matrix. Each of the cubes can contain about 90 V % of diamond (about 10 microns in grain size) and the remaining phase can be either silicon or SiC. A very small amount of titanium can be used facilitate the sintering process. The cubes can be pressed in a graphite mold and formed in a size of about 1 mm on each side. While the cubic examples provided above have proven particularly efficacious, it is to be understood that a variety of sizes and configurations of polycrystalline materials can be utilized in the present invention.

By forming the cutting elements from individual units of superhard polycrystalline material, in defined geometric shapes, arrangement of the cutting elements in a very precise manner becomes much easier. As the defined geometric shapes can be replicated fairly precisely from one cutting element to another, the positioning of, and accordingly, the stress impinged upon, each cutting element can be accomplished fairly consistently across the face off the cutting device in question. With prior art abrasive grits, for example, the overall shape and size of each a plurality of grits might change considerably from one grit to another, making precise placement of the grits difficult to accomplish.

The material utilized in the organic material layer 14 can vary widely. Numerous organic materials are known to those skilled in the art which would be useful when utilized in embodiments of the present invention, and are considered to be included herein. The organic material layer can be any curable resin material, resin, or other polymer with sufficient strength to retain the individual polycrystalline cutting elements of the present invention. It may be beneficial to use an organic material layer that is relatively hard, and maintains a flat surface with little or no warping. This allows the abrading tool to incorporate very small individual polycrystalline cutting elements at least partially therein, and to maintain these small cutting elements at relatively level and consistent heights.

Additionally, various organic materials may act to absorb mechanical forces impinging on the cutting elements disposed therein, and thus spread and equalize such forces across the abrading tool.

Methods of curing the organic material layer can be any process known to one skilled in the art that causes a phase transition in the organic material from at least a pliable state to at least a rigid state. Curing can occur, without limitation, by exposing the organic material to energy in the form of heat, electromagnetic radiation, such as ultraviolet, infrared, and microwave radiation, particle bombardment, such as an electron beam, organic catalysts, inorganic catalysts, or any other curing method known to one skilled in the art.

In one aspect of the present invention, the organic material layer may be a thermoplastic material. Thermoplastic materials can be reversibly hardened and softened by cooling and heating respectively. In another aspect, the organic material layer may be a thermosetting material. Thermosetting materials cannot be reversibly hardened and softened as with the thermoplastic materials. In other words, once curing has occurred, the process is essentially irreversible.

Organic materials that may be useful in embodiments of the present invention include, but are not limited to: amino resins including alkylated urea-formaldehyde resins, melamine-formaldehyde resins, and alkylated benzoguanamine-formaldehyde resins; acrylate resins including vinyl acrylates, acrylated epoxies, acrylated urethanes, acrylated polyesters, acrylated acrylics, acrylated polyethers, vinyl ethers, acrylated oils, acrylated silicons, and associated methacrylates; alkyd resins such as urethane alkyd resins; polyester resins; polyamide resins; polyimide resins; reactive urethane resins; polyurethane resins; phenolic resins such as resole and novolac resins; phenolic/latex resins; epoxy resins such as bisphenol epoxy resins; isocyanate resins; isocyanurate resins; polysiloxane resins including alkylalkoxysilane resins; reactive vinyl resins; resins marketed under the Bakelite trade name, including polyethylene resins, polypropylene resins, epoxy resins, phenolic resins, polystyrene resins, phenoxy resins, perylene resins, polysulfone resins, ethylene copolymer resins, acrylonitrile-butadiene-styrene (ABS) resins, acrylic resins, and vinyl resins; acrylic resins; polycarbonate resins; and mixtures and combinations thereof. In one aspect of the present invention, the organic material may be an epoxy resin. In another aspect, the organic material may be a polyimide resin. In yet another aspect, the organic material may be a polyurethane resin. In yet another aspect, the organic material may be a polyurethane resin.

Numerous additives may be included in the organic material to facilitate its use. For example, additional crosslinking agents and fillers may be used to improve the cured characteristics of the organic material layer. Additionally, solvents may be utilized to alter the characteristics of the organic material in the uncured state. Also, a reinforcing material may be disposed within at least a portion of the solidified organic material layer. Such reinforcing material may function to increase the strength of the organic material layer, and thus further improve the retention of the individual polycrystalline cutting elements. In one aspect, the reinforcing material may include ceramics, metals, or combinations thereof. Examples of ceramics include alumina, aluminum carbide, silica, silicon carbide, zirconia, zirconium carbide, and mixtures thereof.

Additionally, in one aspect a coupling agent or an organometallic compound may be coated onto the surface of each superabrasive particle to facilitate the retention of the superabrasive particles in the organic material matrix via chemical bonding. A wide variety of organic and organometallic compounds are known to those of ordinary skill in the art and may be used. Organometallic coupling agents can form chemicals bonds between the superabrasive particles and the organic material matrix, thus increasing the retention of the particles therein. In this way, the organometallic coupling agent acts as a bridge to form bonds between the organic material matrix and the surface of the superabrasive particles. In one aspect of the present invention, the organometallic coupling agent can be a titanate, zirconate, silane, or mixture thereof.

Specific non-limiting examples of silanes suitable for use in the present invention include: 3-glycidoxypropyltrimethoxy silane (available from Dow Corning as Z-6040); γ-methacryloxy propyltrimethoxy silane (available from Union Carbide Chemicals Company as A-174); β-(3,4-epoxycyclohexyl)ethyltrimethoxy silane, γ-aminopropyltriethoxy silane, N-(β-aminoethyl)-γ-aminopropylmethyldimethoxy silane (available from Union Carbide, Shin-etsu Kagaku Kogyo K.K., etc.); and additional examples of suitable silane coupling agents can be found in U.S. Pat. Nos. 4,795,678, 4,390,647, and 5,038,555, which are each incorporated herein by reference.

Specific non-limiting examples of titanate coupling agents include: isopropyltriisostearoyl titanate, di(cumylphenylate) oxyacetate titanate, 4-aminobenzenesulfonyldodecylbenzenesulfonyl titanate, tetraoctylbis(ditridecylphosphite) titanate, isopropyltri(N-ethylamino-ethylamino)titanate (available from Kenrich Petrochemicals. Inc.), neoalkyoxy titanates such as LICA-01, LICA-09, LICA-28, LICA-44 and LICA-97 (also available from Kenrich), and the like.

Specific non-limiting examples of aluminum coupling agents include acetoalkoxy aluminum diisopropylate (available from Ajinomoto K.K.), and the like.

Specific non-limiting examples of zirconate coupling agents include: neoalkoxy zirconates, LZ-01, LZ-09, LZ-12, LZ-38, LZ-44, LZ-97 (all available from Kenrich Petrochemicals, Inc.), and the like. Other known organometallic coupling agents, e.g., thiolate based compounds, can be used in the present invention and are considered within the scope of the present invention.

The amount of organometallic coupling agent used depends on the coupling agent and on the surface area of the individual polycrystalline cutting elements. Typically, 0.05% to 10% by weight of the organic material layer is sufficient.

Figure 3A:
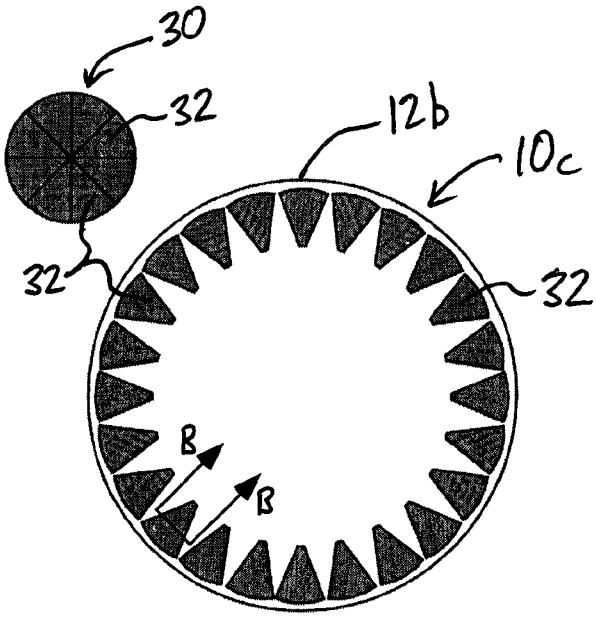
FIG. 3A is a schematic, top plan view of a polycrystalline blank, and a cutting device including individual polycrystalline cutting elements formed from the blank, in accordance with an embodiment of the invention.

Turning now to FIG. 3A, in one aspect of the invention, the individual polycrystalline cutting elements can be obtained and/or formed from a polycrystalline blank of material. One such blank of material is shown at 30 in FIG. 3A, with the polycrystalline blank being formed in a disk having a diameter of roughly 30 mm and a thickness that can vary from around 0.2 mm to upwards of 2 mm.

Figure 3B:
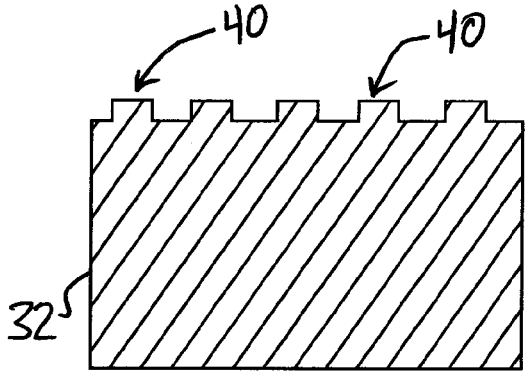
FIG. 3B is an enlarged view of a portion of one cutting element of FIG. 3A, taken along section B-B of FIG. 3A.

The disk 30 can be divided into a series of individual cutting elements in a variety of manners known to those having ordinary skill in the art, including, without limitation, electro-chemical machining, by laser ablation, by plasma etching, by oxidation (to form carbon dioxide or monoxide gas), hydrogenation (to form methane gas), etc. Laser beams with relatively longer wavelengths (e.g. ND:YAG) have been shown to form cutting grooves on PCD effectively (laser beams with relatively short wavelengths (e.g. excimers) may be used to carve out the secondary cutting elements on top of the primary cutting elements, as shown and discussed in connection with FIG. 3B. While the latter may be slower in cutting speed, it is generally more precise due to the shorter wavelength used. Moreover, the surface damage can be less with more concentrated energy in higher frequencies. This has been found suitable for shaving or planing a silicon wafer in accordance with the present invention.

In one aspect of the invention, the material is removed from the PCD or PcBN compact by electrical discharge machining ("EDM"). In this aspect, the EDM process can utilize one or more electrodes that include diamond. For example, the cathode used in the EDM process can be a boron doped diamond material and the anode used in the EDM process can be the PCD (in this case, the PCD would generally need to be at least partially electrically conductive). As current is applied through the boron doped diamond material, the material of the PCD can be carefully and controllably removed to form various cutting elements from the PCD.

As will be appreciated, the disk 30 is divided into 8 similarly shaped and sized wedges 32. In one embodiment of the invention, the wedges 32 can be attached to a base 12*b* by way of the solidified organic material layer discussed above. In the embodiment of the invention illustrated in FIG. 3A, the wedges 32 are radially distributed about the face of the cutting device and/or base or substrate. In this manner, the wedges 32 can be arranged so as to each be subject to substantially the same force (and each be substantially as likely to be retained within the organic matrix) when used to abrade or treat a workpiece (not shown). While not so required, in one embodiment of the invention, the PCD blank 30 can be on the order of about 30 mm in diameter, while the base 12*b* can be on the order of about 100 mm in diameter. Thus, a cutting device with a diameter of around 100 cm can be formed from superhard material taken from a PCD of only about 30 mm.

Figure 4:
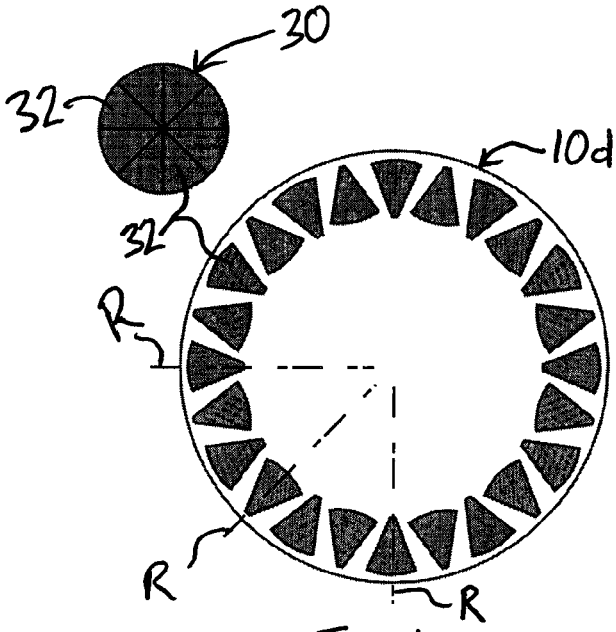
FIG. 4 is a schematic, top plan view of a polycrystalline blank, and a cutting device including individual polycrystalline cutting elements formed from the blank, in accordance with another embodiment of the invention.
Figure 5:
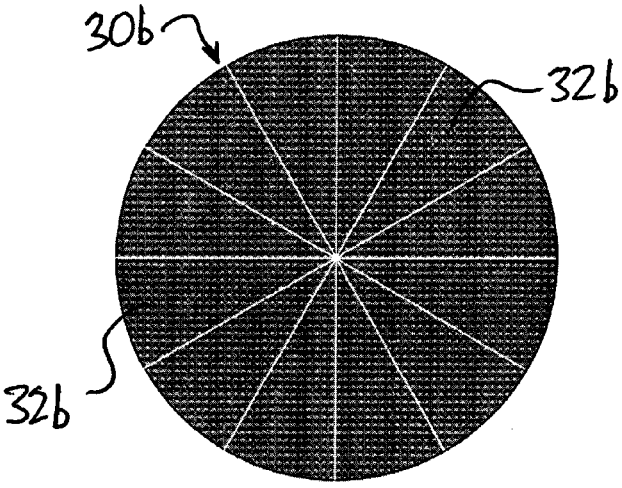
FIG. 5 is a schematic, top plan view of another polycrystalline blank in accordance with an embodiment of the invention, shown with the blank divided into a series of individual cutting elements.
Figure 6:
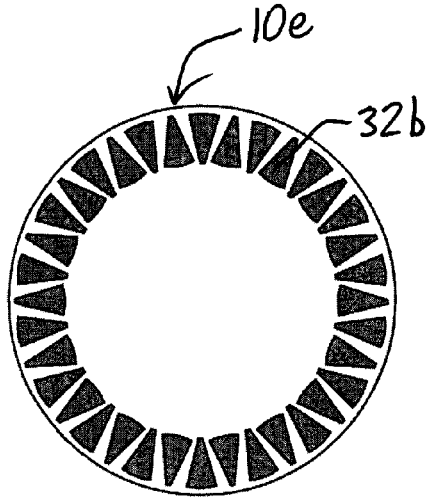
FIG. 6 is a schematic, top plan view of a cutting device including individual polycrystalline cutting elements formed from the blank of FIG. 5 in accordance with another embodiment of the invention.
Figure 7:
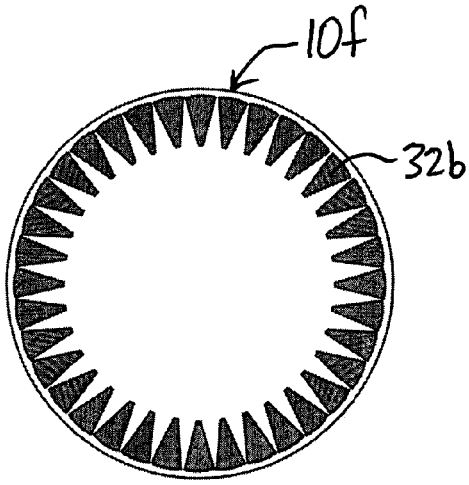
FIG. 7 is a schematic, top plan view of another cutting device, including the individual polycrystalline cutting elements formed from the blank of FIG. 5 in accordance with another embodiment of the invention.
Figure 8:
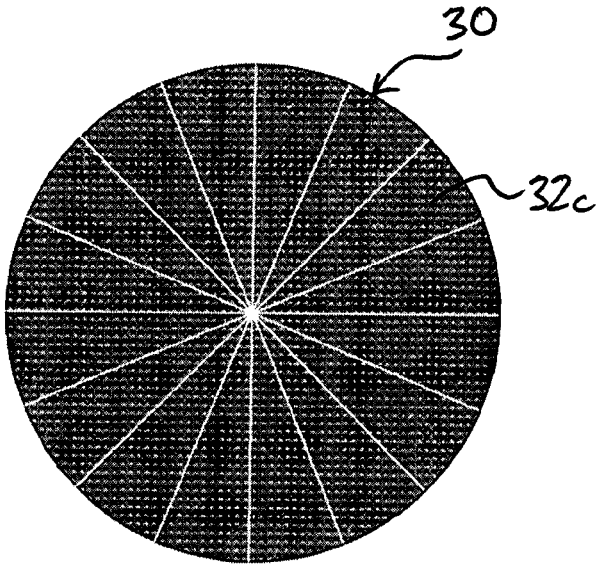
FIG. 8 is a schematic, top plan view of another polycrystalline blank in accordance with an embodiment of the invention, shown with the blank divided into a series of individual cutting elements.
Figure 9:
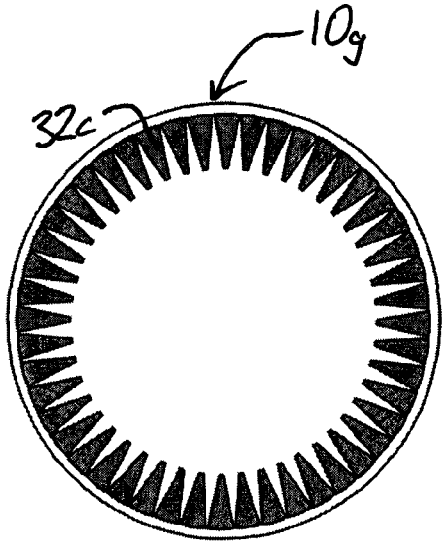
FIG. 9 is a schematic, top plan view of a cutting device, including the individual polycrystalline cutting elements formed from the blank of FIG. 8 in accordance with another embodiment of the invention.
Figure 10:
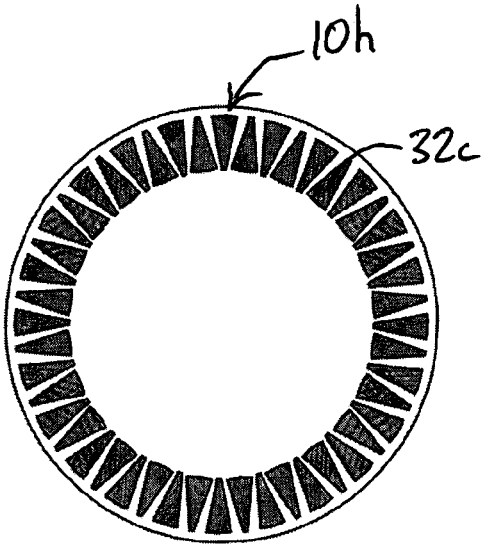
FIG. 10 is a schematic, top plan view of another cutting device, including the individual polycrystalline cutting elements formed from the blank of FIG. 8 in accordance with another embodiment of the invention.
Figure 11:
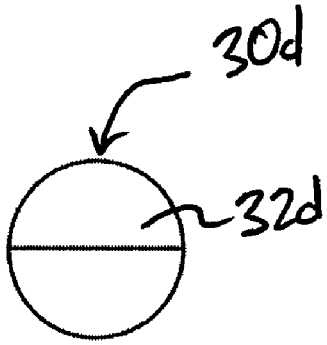
FIG. 11 is a schematic, top plan view of another polycrystalline blank in accordance with an embodiment of the invention, shown with the blank divided into a pair of individual cutting elements.
Figure 12:
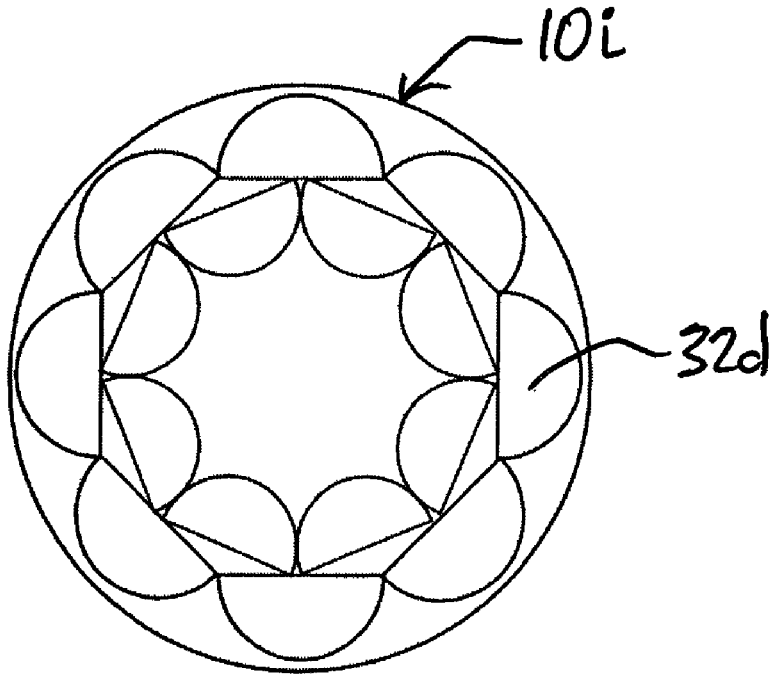
FIG. 12 is a schematic, top plan view of a cutting device including the individual polycrystalline cutting elements formed from the blank of FIG. 11 in accordance with another embodiment of the invention.

As shown in FIG. 4, in one aspect of the invention, a longitudinal axis of each of the individual polycrystalline cutting elements (e.g., wedges 32) is aligned along a radius R of the cutting device. In the embodiment shown, the individual polycrystalline cutting elements are distributed on the cutting device in alternating orientations. The manner of arranging the cutting elements across the face of the base or substrate 12*b* can be varied for particular applications. Due to the consistent shape and size of the individual polycrystalline cutting elements, however, arrangement and attachment of the cutting elements to the base is made considerably easier. Accordingly, varying the arrangement for particular applications can be more easily and accurately accomplished.

By utilizing a relatively small amount of polycrystalline material (e.g., disk 30), relative to the size of the base 12*b* which is to be used to treat the workpiece (not shown), the amount polycrystalline material used can be greatly reduced, leading to considerable cost savings. The present inventor has found, however, that cutting devices of the present invention perform equally well, or nearly equally as well, as conventional cutting devices that utilize "full-face" polycrystalline cutting or grinding tools.

As will be appreciated, the blank 30 of FIG. 3A has been divided into 8 equal portions. However, as shown in FIGS. 5 through 12, the disks 30*b*, 30*c* and 30*d* can be divided into twelve equal portions (represented by wedges 32*b*), sixteen equal portions (represented by wedges 32*c*), two equal portions (represented by wedges 32*d*), and so forth. In this manner, the present invention provides additional flexibility for creation and arrangement of the individual polycrystalline cutting elements across the tool. It is contemplated that a variety of other configurations is also possible, including, without limitation, differently sized and shaped individual polycrystalline cutting elements.

Returning to FIG. 3B, in one aspect of the invention, the individual polycrystalline cutting elements 32 can include a series of secondary cutting elements 40 formed on a face of each of the individual polycrystalline cutting elements. The secondary cutting elements can be configured to maintain a sharpness of each of the cutting elements during use of the cutting device. The secondary cutting elements can vary in shape, and can include rectangular-shaped cutting elements, pyramidal-shaped cutting elements, triangular-shaped cutting elements, etc. The secondary cutting elements can also be formed in a truncated pyramidal shape (not shown). By utilizing secondary cutting elements on the primary cutting elements, the total cutting edge length of the cutting element can be extended by as much as 10,000 times.

In accordance with another aspect, the present invention provides a method of forming a cutting device, comprising: obtaining a substrate; arranging on the substrate a plurality of individual polycrystalline cutting elements, each of the plurality of individual polycrystalline cutting elements having a matching geometric configuration; and securing each of the plurality of individual polycrystalline cutting elements to the substrate with a solidified organic material layer.

The method can further comprise aligning at least one cutting tip of each of the plurality of individual polycrystalline cutting elements in a common plane.

EXAMPLES

The following examples present various methods for making the cutting tools of the present invention. Such examples are illustrative only, and no limitation on present invention is meant thereby.

Example 1

Individual sintered polycrystalline diamond cubes with silicon/SiC as the matrix were used as the cutting elements for forming a CMP pad conditioner. Each of the cubes contains about 90 V % of diamond (about 10 microns in grain size) and the remaining phase is either silicon or SiC. A very small amount of titanium is also present to facilitate the sintering process. The cubes were pressed in a graphite mold and were formed in a size of about 1 mm on each side.

An epoxy mold was provided with cavities configured to receive one apex of the PCD cubes. A parting layer was spread on top of the mold. Subsequently, another epoxy is cast on the top in vacuum. After curing, the mold is removed, exposing the apex of each cube. The apexes become the cutting tip of a pad conditioner.

Example 2

A disk of sintered polycrystalline diamond with silicon/SiC as the matrix is divided into a series of wedges of substantially the same volume. The wedges are used as the cutting elements for forming a CMP pad conditioner. Each of the wedges contains about 90 V % of diamond (about 10 microns in grain size) and the remaining phase is either silicon or SiC. A very small amount of titanium is also present to facilitate the sintering process.

An epoxy mold was provided with cavities configured to receive each of the PCD wedges. A parting layer was spread on top of the mold. Subsequently, another epoxy is cast on the top in vacuum. After curing, the mold is removed, exposing the face of each wedge. The faces (and edges of the faces) of the wedges become the cutting elements of a pad conditioner.

Example 3

PCD blanks pressed from a cubic press were trimmed from both sides to remove refractary metal container (e.g. Ta). The outside diameter of the blanks were ground off. The PCD blanks were bonded to a cemented WC base and the PCD layer was EDM shaped to form pyramids distributed in a predetermined pattern. The PCD blanks were subsequently divided into a series of wedge-shaped cutting pieces and the cutting pieces were placed on a flat mold with the cutting pieces leveled with the mold.

The mold was placed in a vacuum chamber and epoxy is poured over the top. Finally, a stainless steel plate was placed on the top of the flowing epoxy and pressed toward the PCD until only a thin layer of epoxy remained between the backing of the PCD and the steel substrate. After curing of the epoxy, the PCD cutting tool was cleaned and mounting structure (e.g., holes) was formed on the back of the steel substrate.

The PCT cutting pieces can be arranged on the stainless steel plate in an annular ring pattern, circular plates, squares, etc. These patterns can be optimized to suit a particular CMP application.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A cutting device, comprising:

a base having a solidified organic material layer disposed thereon; and a plurality of individual polycrystalline cutting elements, formed from a different material than the solidified organic material layer and being secured in the solidified organic material layer, each of the plurality of individual polycrystalline cutting elements having a substantially matching geometric configuration, each of the individual polycrystalline cutting elements being an equal, divided, wedge-shaped sector of a polycrystalline blank of material shaped as a disk.

2. The cutting device of claim 1, wherein each of the plurality of individual polycrystalline cutting elements includes at least one cutting tip, the tips of the cutting elements being aligned in a common plane.

3. The cutting device of claim 1, wherein the individual polycrystalline cutting elements are radially distributed about the face of the cutting device.

4. The cutting device of claim 1, wherein the individual polycrystalline cutting elements are distributed on the cutting device in alternating orientations.

5. The cutting device of claim 1, further comprising a series of secondary cutting elements formed on a face of each of the individual polycrystalline cutting elements, the secondary cutting elements being configured to maintain a sharpness of each of the cutting elements during use of the cutting device.

6. A cutting device, comprising:

a base having a solidified organic material layer attached thereto;

a plurality of individual polycrystalline cutting elements, formed from a different material than the solidified organic material layer and being secured in the solidified organic material layer, each of the plurality of individual polycrystalline cutting elements including at least one cutting tip, the tips of the cutting elements being aligned in a common plane, each of the individual polycrystalline cutting elements being an equal, divided, wedge-shaped sector of a polycrystalline blank of material shaped as a disk.

7. The cutting device of claim 6, wherein arrangement of the individual polycrystalline cutting elements uniformly distributes drag forces across substantially each individual polycrystalline cutting element.

8. The cutting device of claim 6, wherein a majority of each of the individual polycrystalline cutting elements protrudes to a predetermined height above the solidified organic material layer.

9. The cutting device of claim 8, wherein the predetermined height produces a cutting depth of less than about 20 microns when used to abrade a workpiece.

10. The cutting device of claim 6, wherein each of the plurality of individual polycrystalline cutting elements has a substantially matching geometric configuration.

11. The cutting device of claim 6, wherein the individual polycrystalline cutting elements are radially distributed about the organic material layer.

12. The cutting device of claim 6, wherein the individual polycrystalline cutting elements are of substantially the same size and substantially the same shape.

13. The cutting device of claim 6, wherein the individual polycrystalline cutting elements are arranged as a grid.

14. The cutting device of claim 13, wherein the individual polycrystalline cutting elements are evenly spaced from one another at a distance of from about 100 microns to about 800 microns.

15. The cutting device of claim 14, wherein the individual polycrystalline cutting elements are evenly spaced from one another at a distance of about 500 microns.

16. The cutting device of either of claim 1 or claim 6, wherein the solidified organic material layer comprises a member selected from the group consisting of amino resins, acrylate resins, alkyd resins, polyester resins, polyamide resins, polyimide resins, polyurethane resins, phenolic resins, phenolic/latex resins, epoxy resins, isocyanate epoxy resins, isocyanate resins, isocyanurate resins, polysiloxane resins, reactive vinyl resins, polyethylene resins, polypropylene resins, polystyrene resins, phenoxy resins, perylene resins, polysulfone resins, acrylonitrile-butadiene-styrene resins, acrylic resins, polycarbonate resins, polyimide resins, and mixtures thereof.

17. The cutting device of claim 16, wherein the solidified organic material layer is an epoxy resin.

18. The cutting device of claim 16, wherein the solidified organic material layer is a polyurethane resin.

19. The cutting device of claim 16, wherein the solidified organic material layer is a polyimide resin.

20. The cutting device of claim 16, further comprising a reinforcing material disposed within at least a portion of the solidified organic material layer.

21. The cutting device of claim 20, wherein the reinforcing material is a material selected from the group consisting of ceramics, metals, or combinations thereof.

22. A method of forming a cutting device, comprising:

obtaining a substrate;

dividing a polycrystalline disk blank into a plurality of individual polycrystalline cutting elements, each of the cutting elements having a substantially matching geometric configuration and being a substantially equal, divided, wedge-shaped sector of the disk blank;

arranging on the substrate the plurality of individual polycrystalline cutting elements; and securing each of the plurality of individual polycrystalline cutting elements to the substrate with a solidified organic material layer, wherein the solidified organic material layer and the polycrystalline cutting elements are formed from different materials.

23. The method of claim 22, further comprising aligning at least one cutting tip of each of the plurality of individual polycrystalline cutting elements in a common plane.

24. The method of claim 22, wherein the individual polycrystalline cutting elements are radially distributed about the substrate.

25. The method of claim 22, wherein the individual polycrystalline cutting elements are evenly spaced from one another at a distance of from about 100 microns to about 800 microns.

26. The cutting device of either of claim 1 or claim 6, wherein the polycrystalline cutting elements comprise superhard polycrystalline cutting elements.

27. The cutting device of claim 26, wherein the superhard polycrystalline cutting elements comprise superhard polycrystalline particles.

28. The method of claim 22, where the polycrystalline cutting elements comprise superhard polycrystalline cutting elements.

29. The method of claim 28, wherein the superhard polycrystalline cutting elements comprise superhard polycrystalline particles.

30. The method of claim 28, wherein the superhard polycrystalline cutting elements are selected from the group consisting of: polycrystalline diamond and polycrystalline cubic boron nitride.

* * * * *